US006208067B1

(12) United States Patent
Nakagawa et al.

(10) Patent No.: US 6,208,067 B1
(45) Date of Patent: Mar. 27, 2001

(54) COLOR CATHODE RAY TUBE

(75) Inventors: Shinichiro Nakagawa; Norio Shimizu; Takuya Mashimo, all of Fukaya; Masatsugu Inoue, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/255,016

(22) Filed: Feb. 22, 1999

(30) Foreign Application Priority Data

Feb. 23, 1998 (JP) ..... 10-040583

(51) Int. Cl.[7] ..... H01J 29/10

(52) U.S. Cl. ..... 313/461; 313/402; 313/407; 313/415; 313/477 R; 313/463

(58) Field of Search ..... 313/477 R, 461, 313/463, 408, 402, 407, 415

(56) References Cited

U.S. PATENT DOCUMENTS 5,432,402 7/1995 An .

6,025,676 * 2/2000 Ohama et al. ..... 313/477 R

* cited by examiner

*Primary Examiner*—Frank G. Font
*Assistant Examiner*—Roy M. Punnoose
(74) *Attorney, Agent, or Firm*—Oblon, Spivak, McClelland, Maier & Neustadt, P.C.

(57) ABSTRACT

In a color cathode ray tube comprising a panel with a substantially rectangular effective portion whose outside face is almost flat or slightly curved and whose inside face has a curvature in the direction of minor axis near the short sides of the portion, and a fluorescent substance screen having a substantially rectangular effective region formed on the inside face of the effective portion of the panel, the short sides in the outer circumference of the effective region of the fluorescent substance screen are projected toward the center of the effective region. This improves the flatness of images appearing on the fluorescent substance screen provided on the inside face of the effective portion in the color cathode ray tube with the outside face of the effective portion of the substantially rectangular panel being almost flat and the inside face having a curvature in the direction of minor axis at least near the short sides.

7 Claims, 3 Drawing Sheets

COLOR CATHODE RAY TUBE

BACKGROUND OF THE INVENTION

1. Field of the Invention

This invention relates to a color cathode ray tube, and more particularly to a color cathode ray tube which includes a panel with a substantially rectangular effective portion whose outside face is almost flat or slightly curved and whose inside face has a curvature in the direction of minor axis near the short sides of the portion and which thereby improves the flatness of images appearing on the effective portion.

2. Discussion of the Background

Generally, a color cathode ray tube includes a vacuum enclosure made of a glass panel and a glass funnel. The effective portion of the glass panel on which images are displayed is substantially rectangular. On the inside face of the effective portion of the panel, a fluorescent substance screen composed of a three-color fluorescent substance layer is provided. On the inside, a substantially rectangular shadow mask is provided so as to face the fluorescent substance screen. The shadow mask is composed of a mask body and a mask frame provided on the periphery of the mask body. The mask body is such that a large number of electron beam passing holes have been made in a substantially rectangular effective surface.

In the color cathode ray tube with such a configuration, three electron beams emitted from an electron gun provided in the neck of the funnel are deflected by a deflection unit on the outside of the funnel toward the fluorescent substance screen through the shadow mask. The electron beams scan the fluorescent substance screen horizontally and vertically, thereby producing a color image on the fluorescent substance screen.

In recent years, effort has been directed toward flattening the image display section of the color cathode ray tube to improve the visibility of images. Specifically, in the color cathode ray tube, the inside and outside faces of the effective portion of the panel are generally fattened. Since the clearance (q value) between the inside face of the panel's effective portion and the effective surface of the shadow mask facing the fluorescent substance screen provided on the inside face of the effective portion must be maintained within specific permitted limits, the effective surface of the shadow mask is also required to be flattened. Flattening the effective surface of the shadow mask introduces the danger of decreasing the strength with which the curved surface of the shadow mask is retained. Therefore, even when the outside face of the effective portion of the panel has been flattened, its inside face has been often left curved.

One example of such a color cathode ray tube has been disclosed in Japanese Patent Application No. 8-49030 (Japanese Laid Open Patent Publication No. H9-245685). In the application, the following panel of a color cathode ray tube has been proposed. In the panel, the outside face of its effective portion is made almost flat. The inside face of its effective portion is formed into a cylindrical curved surface, with the radius of curvature in the direction of major axis of the inside face being almost infinite and the radius of curvature in the direction of minor axis being almost constant. In the color cathode ray tube where the inside face of the effective portion of the panel has a cylindrical curved surface, the effective surface of the shadow mask located inside is also formed into a cylindrical curved surface having a curvature in the direction of minor axis so as to correspond to the inside face of the effective portion of the panel.

In a color cathode ray tube the effective surface of whose shadow mask is a cylindrical curved surface having a curvature in the direction of minor axis and which has a black stripe fluorescent substance screen composed of a striped black light absorption layer, each stripe long and narrow in the direction of minor axis of the panel, and a striped three-color fluorescent substance layer provided so as to fill up the spacing of the light absorption layer, making the curvature in the direction of minor axis larger than that in the direction of major axis helps improve the curved-surface retaining strength. Specifically, in the black stripe color cathode ray tube, electron beam passing holes in the effective surface of the shadow mask are arranged in the direction of minor axis. The slit-like electron beam passing holes are arranged in a line via a narrow bridge. Lines of electron beam passing holes extending in the direction of minor axis are arranged with a specific arrangement pitch in the direction of major axis. Therefore, when the flatness of the shadow mask is almost the same, making the curvature in the direction of minor axis than that in the direction of major axis helps improve the strength with which the curved surface is retained. Such a structure is particularly effective for a wide tube with an aspect ratio of 16:9.

Furthermore, the following configuration has been proposed for a panel and a shadow mask suited to flatten the image display section. For the inside face of the effective portion of the panel, the radius of curvature in the direction of major axis is made almost infinite near the center of the panel and almost constant on the periphery of the panel. The radius of curvature in the direction of minor axis is made larger near the center of the panel than on the periphery of the panel. When the effective surface 2 of the shadow mask 1 is formed into a curved surface that corresponds to the inside face of the panel as shown in FIG. 1, it is possible to improve the strength with which the curved surface of the shadow mask is retained.

Since an image appears on the fluorescent substance screen provided on the inside face of the effective portion of the panel, the effect of the thickness difference on an image viewed through the effective portion is small in a color cathode ray tube with a small difference in thickness between the center of the effective portion and its periphery. In the case of a panel flattened as described above, the thickness difference between the center of the effective portion and its periphery is greater, increasing the effect of the thickness difference on an image viewed through the effective portion. For an image to appear on a truly flat rectangular plane, the inside and outside faces of the effective portion need to be flat.

Specifically, the flatness of an image appearing on the effective portion of the panel is influenced by not only the shape of the outside face of the effective portion but also the shape of its inside face. In the case of a panel whose image display section has been flattened, a rectangular screen drawn on the fluorescent substance screen formed on the inside face of the effective portion looks like a barrel with the short sides projecting outward from the center of the effective portion, when viewed from the front of the effective portion on the central axis. The tendency is more prominent when the screen is viewed form the side. As a result, the screen does not take the form of a truly rectangular plane and looks round. This prevents flat images from being produced as expected, making no sense to flatten the image display section.

As described above, the image display sections of color cathode ray tubes have recently been flattened to improve the visibility of images. In this connection, the following panel has been proposed. In the panel, the outside face of the effective portion of a panel on which a fluorescent screen is provided is made almost flat. Its inside face is formed into a cylindrical curved surface, with the radius of curvature in the direction of major axis of the inside face being made almost infinite and the radius of curvature in the direction of minor axis being made almost constant. Alternatively, the inside face is formed into a curved surface with the radius of curvature in the direction of major axis being made almost infinite near the center and almost constant on the periphery and the radius of curvature in the direction of minor axis being made larger near the center than on the periphery. In such a panel, even when the outside face of the effective portion is almost flat, the inside face has a curvature in the direction of minor axis at least near the short sides. When a screen drawn on the rectangular fluorescent substance screen formed on the inside face of the effective portion is viewed from the front of the effective portion on the central axis, the short sides looks as if they projected outward from the center of the effective portion. The tendency is more prominent, when the image is viewed from the side. As a result, the screen does not take the form of a truly rectangular plane and looks round. This prevents flat images from being produced as expected, which makes no sense to flatten the image display section.

SUMMARY OF THE INVENTION

The object of the present invention is to a color cathode ray tube which includes a panel with a substantially rectangular effective portion whose outside face is almost flat and whose inside face has a curvature in the direction of minor axis at least near the short sides and which improves the flatness of images drawn on a fluorescent substance screen provided on the inside face of the effective portion.

(1) In a color cathode ray tube comprising a panel with a substantially rectangular effective portion whose outside face is almost flat or slightly curved and whose inside face has a curvature in the direction of minor axis near the short sides of the portion, and a fluorescent substance screen having a substantially rectangular effective region formed on the inside face of the effective portion of the panel, the short sides in the outer circumference of the effective region of the fluorescent substance screen are projected toward the center of the effective region.

(2) In a color cathode ray tube comprising a panel with a substantially rectangular effective portion whose outside face is almost flat or slightly curved and whose inside face has a curvature in the direction of minor axis near the short sides of the portion, and a fluorescent substance screen having a substantially rectangular effective region formed on the inside face of the effective portion of the panel, the long sides in the outer circumference of the effective region of the fluorescent substance screen are made almost straight and the short sides in the outer circumference of the effective region are projected toward the center of the effective region.

(3) In a color cathode ray tube in item (1) or (2), if the difference between one-half the length of the long side of the effective region of the fluorescent substance screen and one-half the major-axis diameter is d, the length of the short side is y, and the curvature rate RS of the short side is defined as $(\%)=(d/y)\times 100$, the curvature rate of the short sides will be made to fulfill $0<RS\leqq 0.8$, when the short sides of the effective region of the fluorescent substance screen are viewed from the front.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Hereinafter, referring to the accompanying drawings, a color cathode ray tube according to an embodiment of the present invention will be explained.

Figure 1:
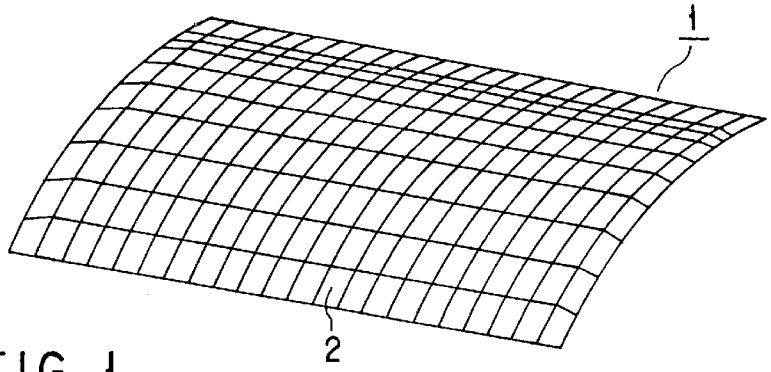
FIG. 1 is a schematic perspective view of the shape of the effective surface of the shadow mask in a conventional color cathode ray tube.
Figure 2:
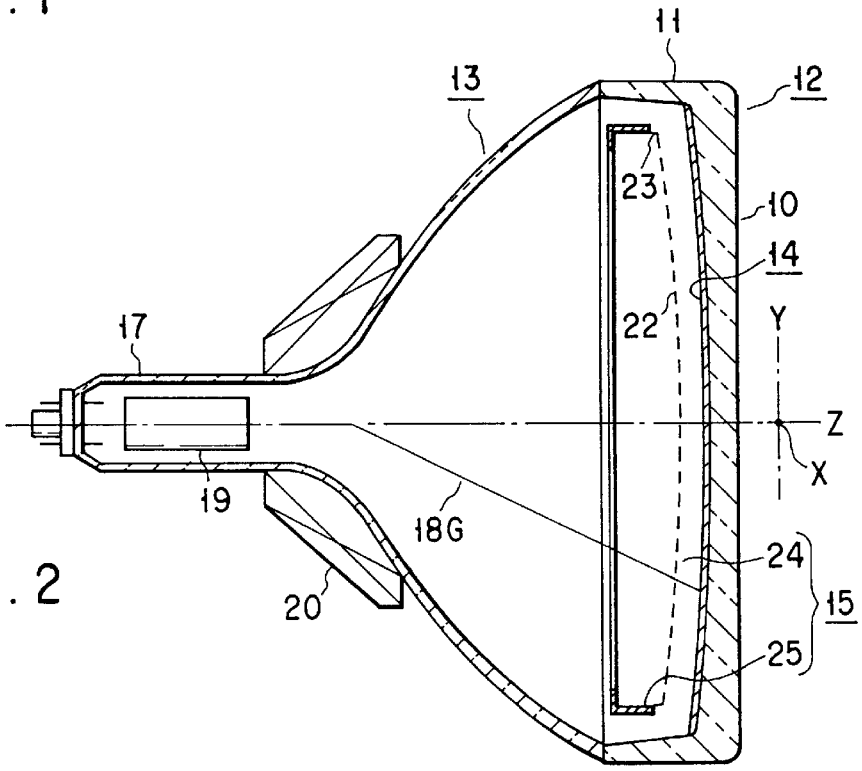
FIG. 2 is a schematic sectional view of a color cathode ray tube according to an embodiment of the present invention.

FIG. 2 is a schematic sectional view of a color cathode ray tube to which the present invention has been applied. The color cathode ray tube has a glass panel 12, which has a substantially rectangular effective portion 10 with a horizontal axis (X-axis) crossing the axis of the tube (Z-axis) at right angles as the major axis and a vertical axis (Y-axis) as the minor axis and a skirt section 11 at the periphery of the effective portion. A vacuum enclosure is composed of a glass funnel 13 connected to the panel 12 and its skirt section 11. On the inside face of the effective portion 10 of the panel 12, there is provided a fluorescent substance screen 14 that has a substantially rectangular effective region composed of a light absorption layer and a three-color fluorescent substance layer provided so as to fill out the spacing of the light absorption layer. The three-color fluorescent substance layer emits blue, green, and red rays of light. A substantially rectangular shadow mask 15 is provided inside the panel 12 so as to face the fluorescent substance screen 14 with a specific distance between them.

In the neck 17 of the funnel 13, there is provided an electron gun 19 that emits three beams 18B, 18G, 18R (only 18G shown in the figure). The three electron beams 18B, 18G, 18R emitted from the electron gun 19 are deflected by an electric field generated by a deflection unit 20 provided on the outside of the funnel 13 and directed to the fluorescent substance screen 14 through the shadow mask 15. The electron beams scan the fluorescent substance screen 14 horizontally and vertically, thereby causing a color image to appear on the fluorescent substance screen 14.

The panel 12 has a flattened effective portion 10. The outside face of the effective portion 10 is made almost flat. As for its inside face, the radius of curvature in the direction of major axis is made almost infinite near the center of the inside face and almost constant on its periphery. Furthermore, the inside face of the effective portion 10 is formed into a curved surface with the radius of curvature in the direction of minor axis being almost constant. Alternatively, the inside face is formed into a curved surface with the radius of curvature in the direction of minor axis being almost constant near the center so that the radius of curvature in the direction of minor axis is larger on the periphery than near the center.

The shadow mask 15 facing the panel 12 with such a curvature is composed of a mask body 24 whose front shape is substantially rectangular and a substantially rectangular mask frame provided on the skirt section 23 of the mask body 24. The mask body 24 is such that a large number of electron beam passing holes are made in the effective surface 22 facing the fluorescent substance screen 14 and the skirt section 23 is provided on the periphery of the effective surface 22. The effective surface 22 of the mask body 24 is formed into a curved surface that corresponds to the shape of the inside face of the effective portion 10 of the panel 12.

Figure 3:
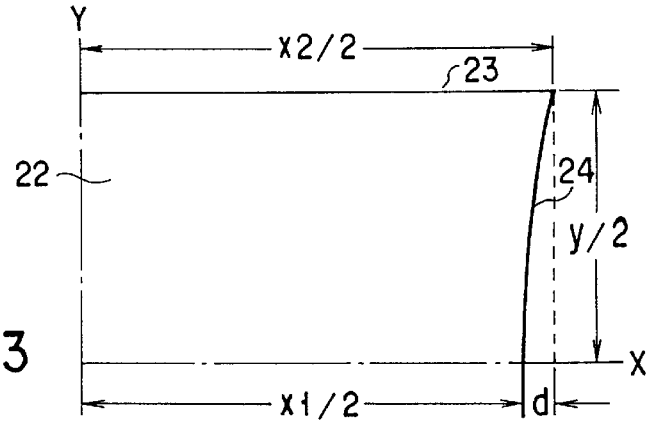
FIG. 3 is a diagram to help explain the shape of the short sides of the effective region of the fluorescent substance screen in the color cathode ray tube of FIG. 1.

In such a color cathode ray tube, the long sides in the outer circumference of the effective region of the fluorescent substance screen 14 are made almost straight and its short sides are made such a circular arc (or pincushion) as projects toward the center of the effective region when the effective region is viewed from above the central line (corresponding to the axis of the tube) of the effective portion 10 of the panel 12. As shown in FIG. 3, if the major-axis diameter of the effective region 22 is x1, the length of the long side 23 is x2, and the length of the short side 24 is y, the amount of projection of the circular arc short side on the X-axis will be:

$$d=x2/2-x1/2$$

If the curvature rate RS of the short side 24 is defined as:

$$RS\ (\%)=(d/y)\times 100$$

then, the curvature rate RS of the short side 24 will be made to meet the following expression:

$$0<RS\leqq 0.8$$

The inside face of the effective portion 10 of the panel 12 is formed into a curved surface with the radius of curvature in the direction of major axis being made infinite near the center of the inside face and being made almost constant on its periphery and the radius of curvature in the direction of minor axis being made almost constant. Alternatively, the inside face is formed into a curved surface with the radius of curvature in the direction of minor axis near the center of the inside face being made almost constant so that the radius of radius in the direction of minor axis on the periphery of the inside face may be smaller than that near its center. When the fluorescent substance screen 14 the shape of whose effective region 22 has been restricted as described above is provided on the inside face of the effective portion 10 of the panel 12, a screen drawn on the effective region 22 of the fluorescent substance screen 14 takes the form of an acceptable rectangular plane when viewed from the front of the effective portion 10 on the central axis. This improves the flatness of the image display section.

Hereinafter, a concrete example will be explained.

EXAMPLE

Figure 4:
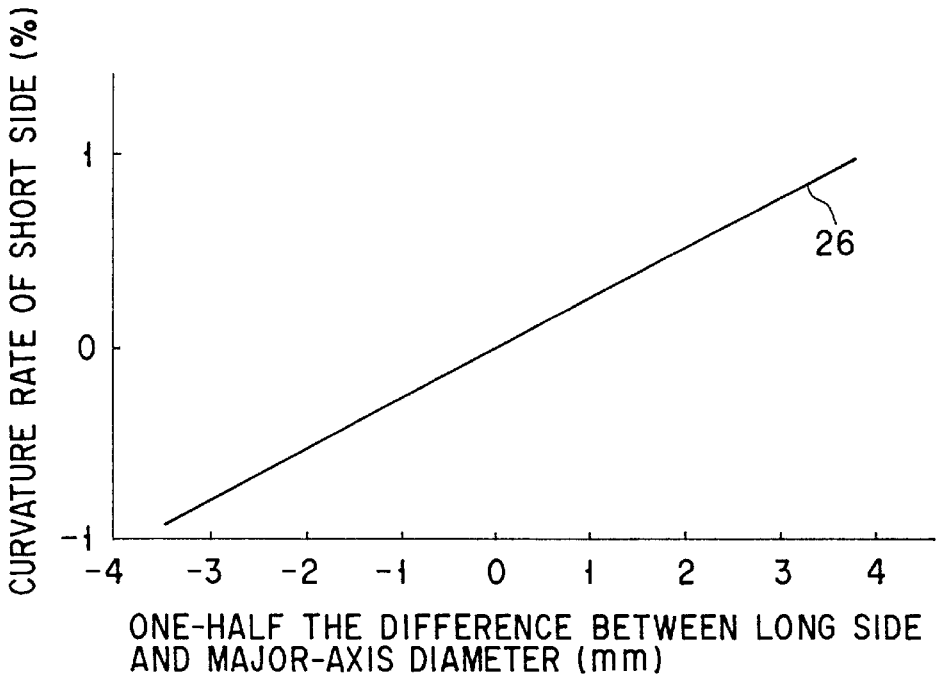
FIG. 4 is a graph showing the relationship between the difference between one-half the major-axis diameter of the effective region of the fluorescent substance screen in FIG. 1 and one-half the length of the long side and the curvature rate of the short side of the effective region.

In a color cathode ray tube composed of a widely used panel whose effective portion is substantially rectangular and has an aspect ratio of 16:9 and a 76-cm-long diagonal, when the short sides of the effective section of the fluorescent substance screen provided on the inside face of the effective portion of the panel is viewed from the front, the curvature rate RS of the short sides changes according to the difference d between one-half the major-axis diameter x1 of the effective region and one-half the length x2 of the long side as shown by line 26 in FIG. 4. When the difference d is smaller than 3 mm, RS is 0.8% or less.

Figure 5:
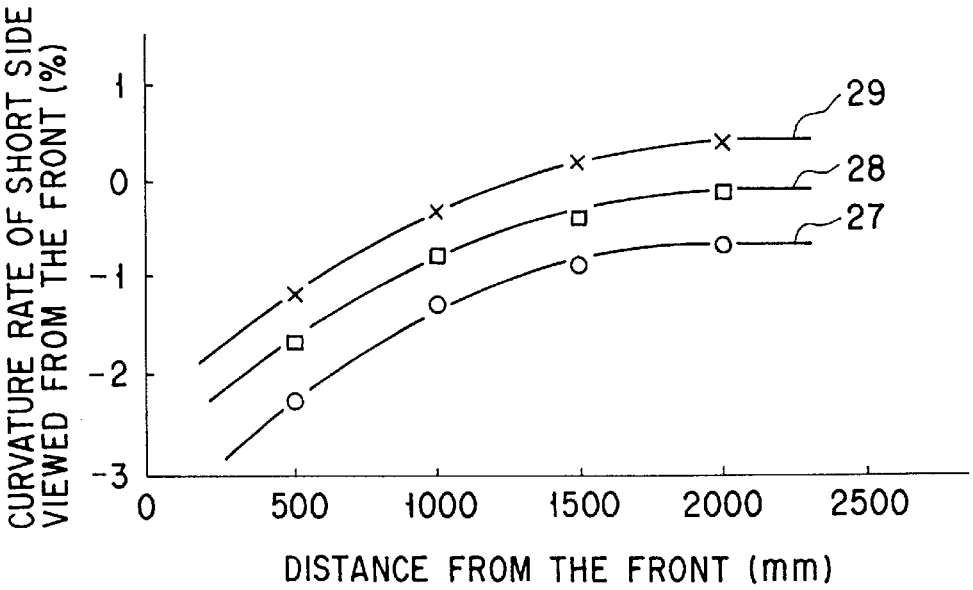
FIG. 5 is a diagram showing the relationship between the distance from the screen drawn on the effective region of the fluorescent substance screen on the central axis of the effective portion of the panel in FIG. 1 and the curvature rate of the short side of the effective region.

In FIG. 5, the radius of curvature of the outside face of the panel's effective portion has been set to about 100,000 mm in the color cathode ray tube, making the outside face almost flat. The inside face of the effective portion of the panel is formed into a curved surface with the radius of curvature in the direction of major axis being made almost infinite near the center of the inside face and being almost constant on its periphery and the radius of curvature in the direction of minor axis being made almost constant. Alternatively, the inside face is formed into a curved surface with the radius of curvature in the direction of minor axis near the center of the inside face being made almost constant so that the radius of radius in the direction of minor axis on the periphery of the inside face may be smaller than that near its center. On the inside face of the effective portion flattened as described above, a substantially rectangular fluorescent substance screen the short sides of whose effective region are curved is provided. Curved lines 27 to 29 in FIG. 5 represent the curvature rate of the short sides of the screen viewed from the center of the effective region when the distance from the screen is changed on the central axis of the effective portion of the panel.

Curved line 27 shows the curvature rate in a case where the difference d between one-half the major-axis diameter x1 of the effective region of the fluorescent substance screen and one-half the length x2 of the long side is 0 mm. Curved line 28 shows the curvature rate for the difference d of 1 mm, and curved line 29 shows the curvature rate for the difference d of 2 mm. In these cases, the index of refraction of glass of the panel has not been taken into account. The curvature of the short side is determined to be positive when the short side projects toward the center of the effective region and to be negative when the short side projects outward.

Figure 6A:
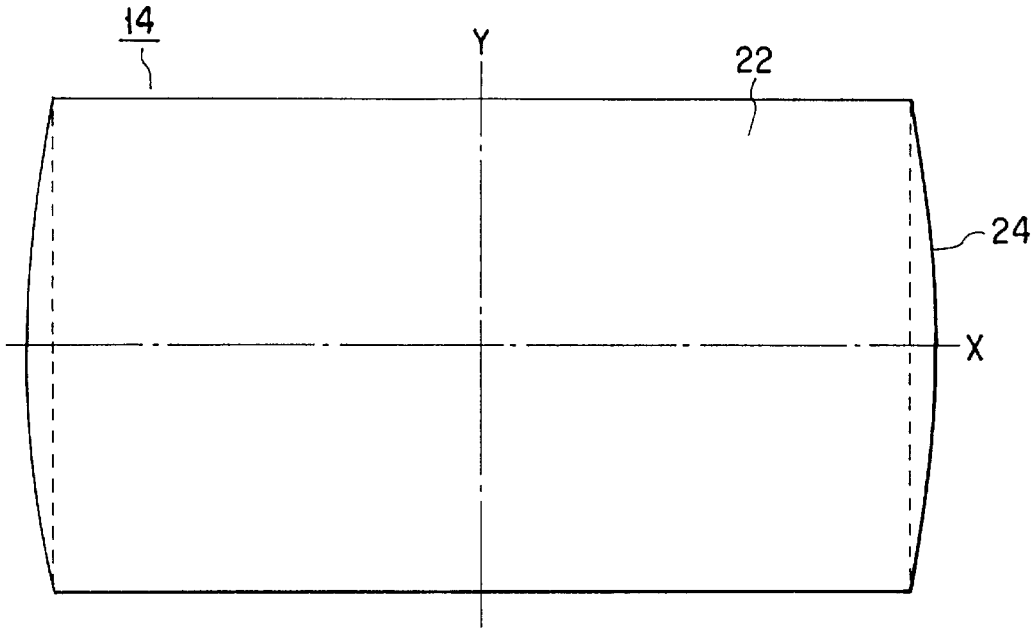
FIGS. 6A and 6B are diagrams to help explain the curvature of the short sides when a screen drawn on the effective region of the fluorescent substance screen is viewed from the front of the effective portion of the panel on the central axis.
Figure 6B:
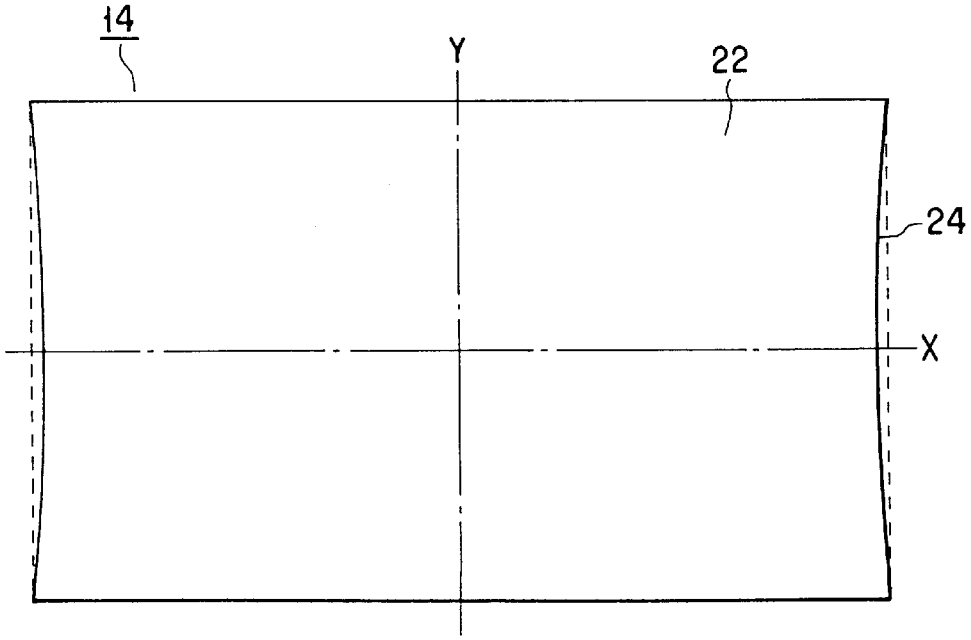

In FIG. 5, when d=0 mm (curved line 27), although the effective region of the fluorescent substance screen is almost rectangular (the long sides project outward with a curvature radius of about 5500 mm), it takes the form of a barrel or projects toward outside the effective region 22 as shown in FIG. 6A because of the difference in thickness between the center of the effective portion of the panel and its periphery. In contrast, when d=1 mm (curved line 28), the absolute value of the curvature rate of the short sides is 0.5% or less as shown in FIG. 5B at a distance of 1.5 m or more at which people are considered to watch television. In this situation, people can watch television without a sense of incongruity. When d=2 mm (curved line 29), the absolute value of the curvature rate of the short side is 0.5% or less at a distance of 1.0 m or less from the screen. When the distance exceeds 1.5 m, however, the short sides project slightly outward. The absolute value of the curvature rate of the short sides is about 0.5% up to a distance of about 3.0 m from the screen. The result was that people had no sense of incongruity.

While in the embodiment, the outside face of the effective portion of the panel has been almost flat, the present invention may be applied to a case where the outside face of the effective portion is curved slightly.

In the above embodiment, the inside face of the effective portion of the panel has been formed into a curved surface with the radius of curvature in the direction of major axis being set infinite near the center of the inside face and being set almost constant on its periphery and the radius of curvature in the direction of minor axis being set almost constant. Alternatively, the inside face has been formed into a curved surface with the radius of curvature in the direction of minor axis near the center of the inside face being made almost constant so that the radius of radius in the direction of minor axis on the periphery of the inside face may be smaller than that near its center. The present invention may be applied to a case where the inside face of the effective portion of the panel is made up of a curved surface having a curvature in the direction of minor axis at least near the short sides, such as a case where the inside face is composed of a cylindrical curved surface with the radius of curvature in the direction of major axis being made almost infinite and the radius of curvature in the direction of minor axis being made constant. The application of the invention to these cases produces similar effects.

As described above, the flatness of images appearing on the effective region of the fluorescent substance screen is improved by constructing the effective region of the fluorescent substance screen as described above. The fluorescent substance screen is provided on the inside face of the effective portion of the panel whose outside face is almost flat or curved slightly and whose inside face has a curvature in the direction of minor axis at least near the short sides.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed as new and desired to be secured by Letters Patent of the United States is:

1. A color cathode ray tube comprising:

a panel having a substantially rectangular effective portion with an outside face that is almost flat and an inside face that has a curvature in the direction of a minor axis near short sides of the effective portion; and a fluorescent substance screen having a substantially rectangular effective region formed on the inside face of the effective portion of the panel, wherein the short sides in an outer circumference of the effective region are curved so as to project toward the center of the effective region.

2. A color cathode ray tube according to claim 1, wherein a difference between one-half the length of a long side of the effective region of the fluorescent substance screen and one-half a major-axis diameter is d, the length of the short side is y, and the curvature rate RS of the short side is defined as $(\%)=(d/y)\times 100$, the curvature rate of the short sides being $0<RS\leq 0.8$, when the short sides of the effective region of the fluorescent substance screen are viewed from the front.

3. A color cathode ray tube comprising:

a panel having a substantially rectangular effective portion with an outside face that is almost flat and an inside face that has a curvature in a direction of a minor axis near short sides of the effective portion; and a fluorescent substance screen having a substantially rectangular effective region formed on the inside face of the effective portion of the panel, wherein long sides of the outer circumference of the effective region are almost straight and the short sides of the outer circumference of the effective region project toward the center of the effective region to form a curved surface.

4. A color cathode ray tube according to claim 3, wherein a difference between one-half the length of the long side of the effective region and one-half a major-axis diameter is d, the length of the short side is y, and the curvature rate RS of the short side is defined as $(\%)=(d/y)\times 100$, the curvature rate of the short sides being $0<RS\leq 0.8$, when the short sides of the effective region of the fluorescent substance screen are viewed from the front.

5. A color cathode ray tube comprising:

a panel having a substantially rectangular effective portion with an outside face that is nearly flat and an inside face that has a curvature in a direction of minor axis near short sides of the effective portion; and a fluorescent substance screen having a substantially rectangular effective region formed on the inside face of the effective portion of the panel, wherein the short sides in an outer circumference of the effective region are curved so as to project toward the center of the effective region, the short sides having a prescribed curvature rate that is defined as $(\%)=(d/y)\times 100$, where d is a difference between one-half a length of a long side of the effective region and one-half a major-axis diameter, y is the length of the short side.

6. A color cathode ray tube according to claim 5, wherein the curvature rate RS is between about 0 and about 0.8.

7. A color cathode ray tube according to claim 5, wherein long sides of the outer circumference of the effective region are almost straight.

* * * * *